United States Patent [19]

Chandhok et al.

[11] Patent Number: 4,915,891

[45] Date of Patent: Apr. 10, 1990

[54] METHOD FOR PRODUCING A NONCIRCULAR PERMANENT MAGNET

[75] Inventor: Vijay K. Chandhok; Bao-Min Ma, both of Pittsburgh, Pa.

[73] Assignee: Crucible Materials Corporation, Pittsburgh, Pa.

[21] Appl. No.: 126,201

[22] Filed: Nov. 27, 1987

[51] Int. Cl.[4] ..... H01F 7/06; B22F 7/00

[52] U.S. Cl. ..... 264/112; 29/607; 29/608; 72/253.1; 148/101; 264/DIG. 58; 419/8

[58] Field of Search ..... 264/125, 112, 119, DIG. 58; 29/608, 607; 419/8, 41, 67, 48, 51, 68; 72/253.1, 272; 148/101, 105

[56] References Cited

U.S. PATENT DOCUMENTS

| | | | |
|---|---|---|---|
| 2,123,416 | 7/1938 | Graham | 264/DIG. 66 X |
| 2,960,221 | 11/1960 | Albers et al. | 72/272 |
| 2,968,835 | 1/1961 | Weston, Jr. et al. | 72/272 |
| 2,974,791 | 3/1961 | Elkan | 72/272 |
| 3,256,591 | 6/1966 | Muller | 264/DIG. 58 |
| 3,922,769 | 12/1975 | Brenan | 419/48 |
| 4,521,360 | 6/1985 | Fiorentino | 264/108 |
| 4,533,407 | 8/1985 | Das et al. | 29/608 X |
| 4,597,938 | 7/1986 | Matsuura et al. | 419/23 |

FOREIGN PATENT DOCUMENTS

| | | | |
|---|---|---|---|
| 667366 | 7/1963 | Canada | 29/608 |

*Primary Examiner*—Jan H. Silbaugh
*Assistant Examiner*—Marylynn Fertig
*Attorney, Agent, or Firm*—Finnegan, Henderson, Farabow, Garrett & Dunner

[57] ABSTRACT

A method for producing a noncircular magnet having asymmetric magnetic properties along axes thereof. A particle charge of composition from which the magnet is to be produced is placed in a container, heated and extruded within the container to compact the particle charge to substantially full density. The particle charge may include at least one rare earth element. The particle charge may be extruded through a noncircular extrusion die, specifically a rectangular die.

6 Claims, No Drawings

METHOD FOR PRODUCING A NONCIRCULAR PERMANENT MAGNET

BACKGROUND OF THE INVENTION

1. Field of the Invention

This invention relates to a method for producing a noncircular permanent magnet having asymmetric magnetic properties along axes thereof.

2. Description of the Prior Art

It is known to produce permanent magnets by compacting particle charges of the composition from which the permanent magnet is to be made. Permanent magnets of compositions including at least one rare earth element and a transition element are produced by this practice. Specifically, practices of this type include magnetic aligning, pressing and sintering to achieve substantially full density. Magnets so produced exhibit high energy product and anisotropic magnetic properties. It is likewise known to produce cylindrical permanent magnets of these compositions by extruding particle charges of the composition from which the magnet is to be made. Cylindrical magnets produced by extruding exhibit a [100] fiber texture structure which is ideal for use in rotating machinery, beam focussing devices and the like. There are applications, however, where asymmetric magnetic properties are desirable. To date, there is no practice for producing magnets of this structure.

SUMMARY OF THE INVENTION

It is accordingly a primary object of the present invention to provide a method for producing nonsymmetrical permanent magnets having asymmetric magnetic properties along axes thereof.

A more specific object of the invention is a method for producing nonsymmetrical permanent magnets having asymmetric magnetic properties along axes thereof that does not require magnetic field aligning and sintering.

Broadly in accordance with the invention, a noncircular permanent magnet having asymmetric magnetic properties along axes thereof is produced by placing a particle charge of a composition from which the magnet is to be produced in a container. The container and particle charge are heated and extruded to compact the particle charge to substantially full density by mechanical deformation produced during the extruding operation. If the die opening is noncircular, the mechanical deformation during extruding is non-uniform. The extruding may be conducted by the use of a noncircular extrusion die. The noncircular extrusion die may be rectangular. Extrusion ratios within the range of 1.5:1 to 50:1 and extrusion temperatures within the range of 500° to 1500° C. may be employed.

The method of the invention finds particular application to the production of permanent magnets from particle charges comprising at least one rare earth element. The alloy may also include a transition element, such as iron and cobalt, and in addition boron and/or carbon.

DETAILED DESCRIPTION OF THE PREFERRED EMBODIMENTS

EXAMPLE 1

Atomized $(NdDy)_{15}Fe_{79}B_6$ powder was put into a 3⅛" diameter mild steel can, which was heated to 150° C., evacuated and sealed. The can was then heated to 870° C. and extruded to a rectangular shape with dimensions of 1.66" (w)×0.55' (T) at an average extrusion ratio of 8.4 to 1. The magnetic properties are listed in Table I. As can be seen, the rectangular magnet exhibits different magnetic properties along the two principle directions normal to the extrusion direction. The higher the degree of mechanical deformation the higher the $B_r$ (remanence).

TABLE I

| Sample Designation | Test Direction | $B_r$ kG | $H_c$ kOe | $H_{ci}$ kOe | $BH_{max}$ MGOe |
|---|---|---|---|---|---|
| SMA-354 | Transverse 1 | 7.9 | 6.9 | 17.6 | 14.1 |
| | Transverse 2 | 6.8 | 6.0 | 17.3 | 10.5 |

Transverse 1 - Measured along the 0.55" direction.
Transverse 2 - Measured along the 1.66" direction.

The identical powder as used in Example 1 was placed in a 3⅛" diameter can, which was heated to 150° C., evacuated and sealed. The can was heated to 870° C. and extruded into a cylindrical rod with a diameter of 1.00" at an extrusion ratio of 9.8 to 1. The magnetic properties are listed in Table II. The cylindrical shaped magnet has identical magnetic properties along two orthogonal directions (Transverse 1 and 2) perpendicular to the extrusion direction. The identical degree of mechanical deformation results in identical $B_r$ values along these two directions, as shown in Table II.

TABLE II

| Sample Designation | Test Direction | $B_r$ kG | $H_c$ kOe | $H_{ci}$ kOe | $BH_{max}$ MGOe |
|---|---|---|---|---|---|
| SMA-353 | Transverse 1 | 7.0 | 6.4 | 17.1 | 11.7 |
| | Transverse 2 | 7.0 | 6.4 | 17.0 | 11.7 |

As may be seen from the above examples, the method of the invention provides an uncomplex and inexpensive process for producing permanent magnets wherein the magnetic properties of the magnet may be varied in various directions within the magnet. Although the invention has been demonstrated in the specific examples in the production of a solid noncircular magnet, a hollow noncircular magnet may likewise be produced by the method of the invention. For this purpose, the container into which the particles are introduced for extrusion may have a solid core longitudinally disposed therein to define a noncircular chamber into which the particle charge is introduced for extrusion. Upon extrusion and compaction of the particle charge, a hollow noncircular magnet will be produced.

What is claimed is:

1. A method for producing a noncircular magnet having asymmetric magnetic properties along axes thereof, said method comprising placing a particle charge of a composition from which said magnet is to be produced in a container, heating said container and particle charge, and extruding said container and particle charge to compact said particle charge to substantially full density by mechanical deformation produced during said extruding with said mechanical deformation being nonuniform.

2. The method of claim 1 wherein said container and particle charge are extruded through a noncircular extrusion die.

3. The method of claim 2 wherein said noncircular extrusion die is rectangular.

4. The method of claim 1 or claim 2 or claim 3 wherein said particle charge comprises at least one rare earth element.

5. The method of claim 2 or claim 3 wherein said extruding is performed at an extrusion ratio within the range of 1.5:1 to 50:1.

6. The method of claim 2 or claim 3 wherein said extruding is performed at a temperature within the range of 500° to 1500° C.

* * * * *